United States Patent [19]

Ilon

[11] 4,261,561

[45] Apr. 14, 1981

[54] WALKING SUPPORT

[76] Inventor: Bengt E. Ilon, Pilatusstrasse 16, Meggen/Luzern, Switzerland, CH-6045

[21] Appl. No.: 100,651

[22] Filed: Dec. 5, 1979

[30] Foreign Application Priority Data

Dec. 6, 1978 [SE] Sweden ..... 7812547

[51] Int. Cl.[3] ..... A61H 3/04

[52] U.S. Cl. ..... 272/70.3

[58] Field of Search ..... 272/70, 70.3, 70.4; 135/65, 66, 67, 74, 75; 280/87.02 R, 87.02 W, 87.04 R, 87.05, 47.37 C

[56] References Cited

U.S. PATENT DOCUMENTS

| | | | |
|---|---|---|---|
| 906,845 | 12/1908 | Adair | 272/70.4 |
| 2,817,387 | 12/1957 | Blake . | |
| 2,981,312 | 4/1961 | Sundberg | 272/70 |
| 3,098,651 | 7/1963 | Murcott | 272/70.3 |
| 3,279,567 | 10/1966 | Kempel | 272/70.3 |
| 3,442,276 | 5/1969 | Edwards et al. . | |
| 3,641,619 | 2/1972 | Roylance | 272/70 UX |
| 3,658,079 | 4/1972 | Block | 135/67 |
| 3,688,789 | 9/1972 | Bunch | 272/70 UX |
| 3,690,652 | 9/1972 | Schneider | 272/70.3 |

FOREIGN PATENT DOCUMENTS

| | | | |
|---|---|---|---|
| 1423661 | 11/1965 | France . | |
| 2267750 | 11/1975 | France . | |
| 2285849 | 4/1976 | France . | |
| 392034 | 3/1977 | Sweden . | |
| 1048148 | 11/1966 | United Kingdom | 272/70.3 |

*Primary Examiner*—Richard C. Pinkham
*Assistant Examiner*—Arnold W. Kramer
*Attorney, Agent, or Firm*—John J. Dennemeyer

[57] ABSTRACT

The present invention relates to a walking support having a wheeled frame with upright supports and handles for the user of the walking support mounted thereon, whereby the rear wheels of the frame are mounted on lateral members which are pivotally connected to at least one front member of the frame through links. To ensure an especially flexible operation of the walking support, the upright supports and handles are arranged on the lateral members to permit the user of the walking support to move one lateral member at a time. The handles are vertically adjustable. The rear wheels are spring loaded to the lateral members so that downward pressure on the lateral members applies the brakes.

10 Claims, 15 Drawing Figures

WALKING SUPPORT

The present invention relates to a device for walking supports having a wheeled frame and supporting means for the user of the walking support mounted thereon, whereby the rear wheels of the frame are mounted on lateral members which are pivotally connected to at least one front member of the frame through links.

In walking supports of the above type the supporting means are mounted on the front member of the frame since this is considered advantageous for facilitating the handling of the support when used. It has been noted however, that such a construction is rather cumbersome when manoeuvring the walking support in narrow spaces and when the support is used for standing up or sitting down.

The object of the present invention is therefore, in a simple manner, to provide a device for walking supports of the above type making the support far easier to manoeuvre and use. This is accomplished according to the invention by arranging the supporting means on the lateral members to permit the user of the walking support to move one lateral member at a time.

Figure 1:
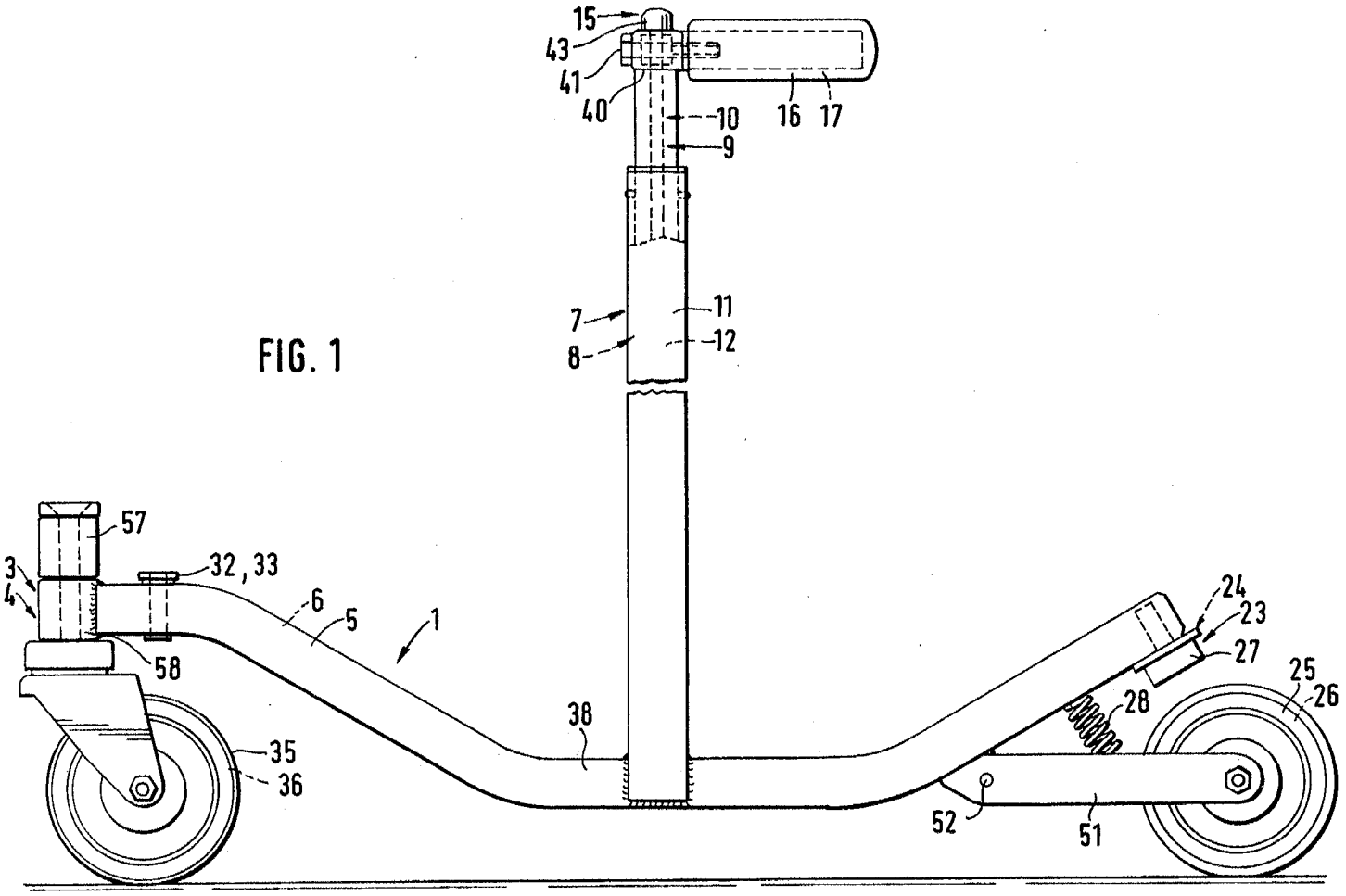
Figure 2:
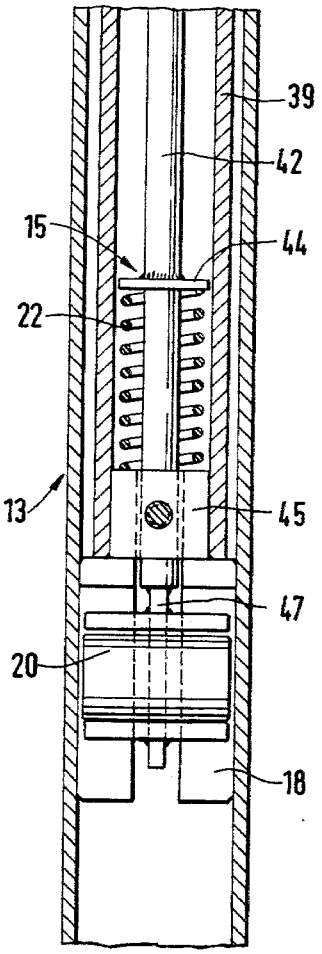
Figure 3:
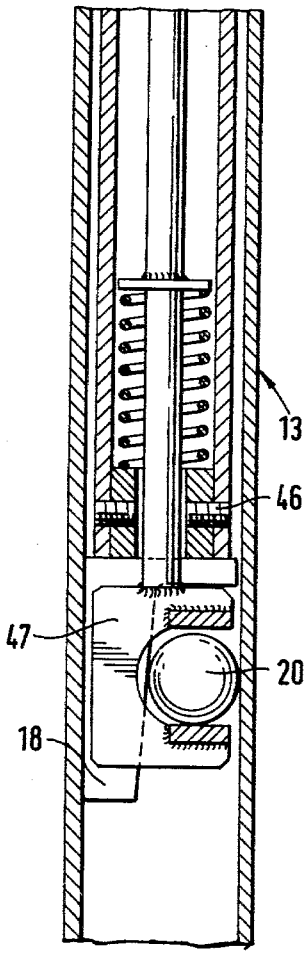
Figure 4:
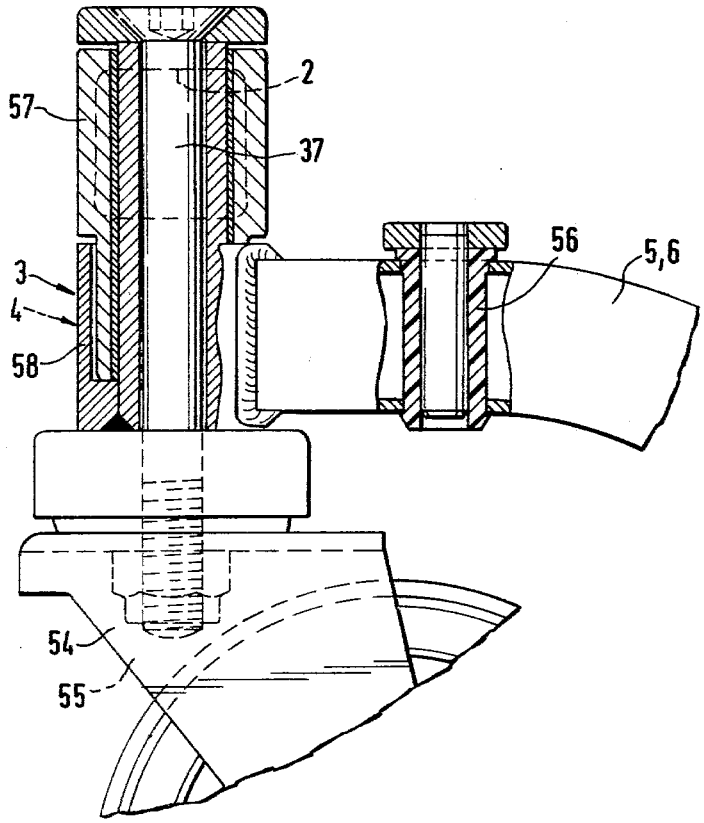
Figure 5:
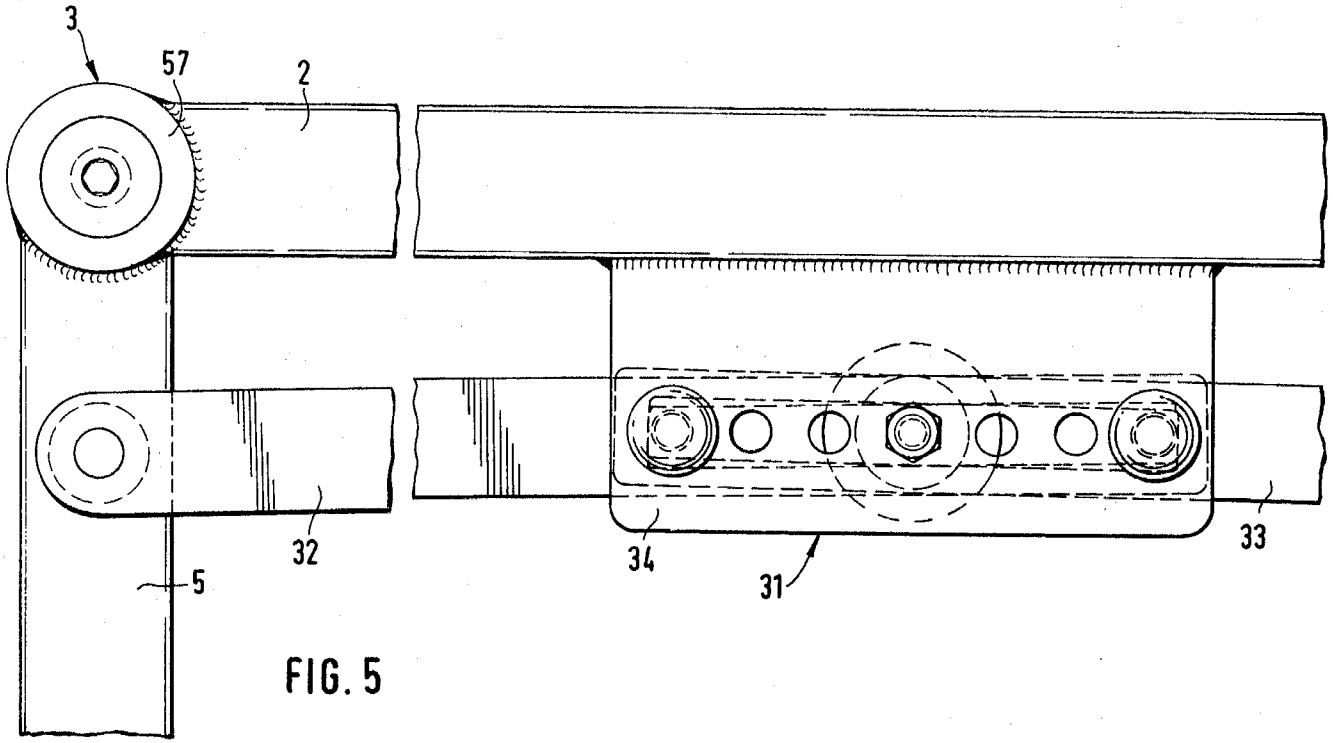
Figure 6:
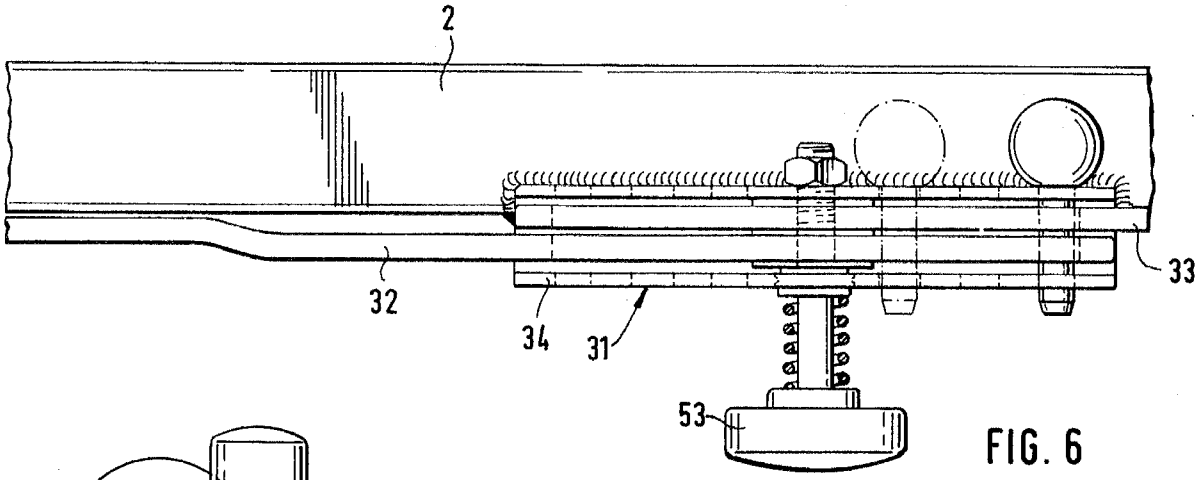
Figure 7:
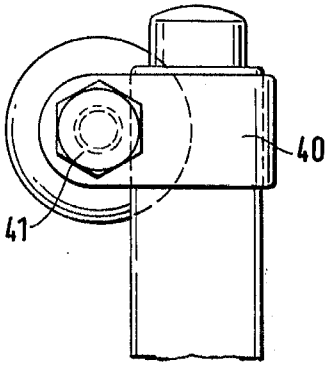
Figure 9:
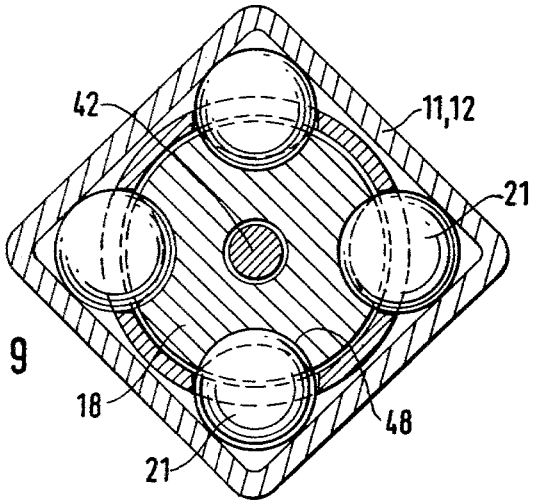
Figure 8:
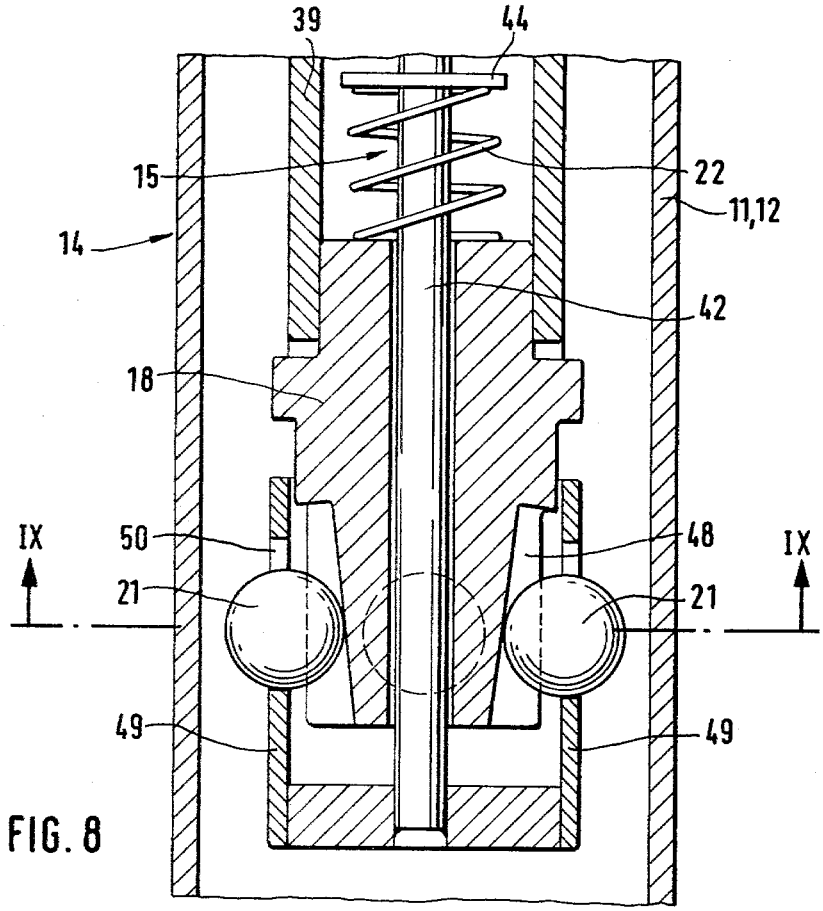

The invention will be described in more detail hereinafter with reference to the accompanying drawings, in which FIG. 1 is a side view of the walking support according to the invention, FIGS. 2 and 3 are various sections through a locking device in the walking support, FIG. 4 is a section through a linkage in the walking support, FIG. 5 is a plan view over a corner portion of the walking support, FIG. 6 is a side view over a lock arrangement shown in FIG. 5, FIG. 7 is a back view over a handle of the walking support, FIG. 8 is a section through a second embodiment of the locking device of the walking support, FIG. 9 is a section along the line IX—IX in FIG. 8, and FIG. 10 A—F shows schematically which forms the frame of the walking support may arrive at when used.

The walking support illustrated in the drawings has a wheeled frame 1 comprising at least one front member 2 and lateral members 5 and 6 pivotally connected to the front member via links 3 and 4. The frame has two supporting means 7 and 8 and it is essential that each supporting means is mounted on one of the lateral members 5 or 6 such that when desired one lateral member may be moved at a time while the other lateral member may be standing still or almost still. Thereby, a walking support is provided which is very easy to manoeuvre and use in narrow spaces and which permits more training moments than have been possible hitherto. Examples of the easy manoeuvrability and usefullness of the walking support will be described below.

For many disabled persons it is difficult to stand up from a sitting position beside the walking support especially if this is rollable to the chair and close to it. To facilitate the "raising moment" each supporting means 7 and 8 respectively, may principally comprise a handle member 9 and 10 respectively, which is vertically adjustably connected to a stand 11 and 12 respectively, mounted on each lateral member 5 and 6 respectively, and which has a locking mechanism 13 or 14 that permits raising of the handle member when this is pulled upwards and lowering of the handle member when this is pressed downwards only after releasing the locking mechanism. The locking mechanism 13 or 14 is preferably built into the stand 11 and 12 respectively, and it is especially easy to manoeuvre and safe in that the locking mechanism is releasable by means of a releasing device 15 reaching up to a handle 16 and 17 respectively, mounted on the handle member, whereby the locking mechanism 13 or 14 comprises at least one wedge means 18 or 19 mounted on the handle member 9 and 10 respectively, and between which and the stand 11 and 12 respectively, is arranged at least one wedge member 20 or 21, which by being wedged up between the wedge means 18 or 19 and the stand 11 and 12 respectively, prevents the handle member 9 and 10 respectively, from moving downwards when loaded, and whereby the releasing device 15 is adapted to move the wedge member 20 or 21 from locking position by pressing down the same against the action of a return spring 22.

It is important to be able to quickly brake the walking support of the present type without need for the disabled person to release his grip around the supporting means. At the present construction it is also essential to be able to brake the wheel on one lateral member such that this member is locked against movement while the other is moved. An especially simple braking device to enable these braking functions comprises a braking device 23 and 24 respectively, on each lateral member 5 or 6, whereby said locking device comprises at least one braking portion 27 which when applying a load on the lateral member 5 and 6 respectively, from above against the action of a return element 28, moves towards the wheel 25 and 26 respectively, and engages the wheel for blocking its rotation.

The illustrated walking support with the arrangements principally described above, may be used as schematically shown in FIGS. 10 A–F. According to this figure moment A shows the support when not used. The frame of the walking support is completely foldable as shown. In moment B, the walking support has been driven to a chair 29 until the supporting means 7 and 8 with the handles 16 and 17 are positioned substantially beside a person sitting in the chair. The handle members 9 and 10 are pushed down in the stands 11 and 12 such that the handles 16 and 17 are set at a level appropriate for use as supports for the person when he wants to stand up. Thereafter, the handles are set at an appropriate level to function as supports for the person when he is walking. This setting is achieved at if the person leans on one handle (e.g. 16) and pulls the other handle member (here 10) out of its stand (here 12) until said handle is set at an appropriate level. Thereafter, the person leans on the set handle (here 16) and pulls the other handle member (here 9) out of its stand (here 11) until this handle (here 17) also is set at an appropriate level.

During these setting moments it is ensured that the walking support does not move if the person press down the handle so much from above that the brakes 23 and/or 24 start to function.

When the settings are made the locking mechanisms 13 and 14 keep the handle members 9 and 10 in the positions set and the person may walk between the lateral members 5 and 6 in a direction from the chair 29 as is shown in moment C.

This movement may be carried out by moving both lateral girders 5, 6 in a forward direction at the same time—as in moment C—or by first moving one lateral member 5 in a forward direction, while the other lateral member 6 is kept still—eventually braked—as is shown in moment D, whereafter the lateral member 5 is kept still—eventually braked—and the lateral member 6 moved forward, as in moment E. As is shown in the positions of moments D and E, it is possible also when moving one lateral member at the time to hold both lateral members parallel to the direction of movement, i.e. the handles are maintained in their normal positions, which is essential for facilitating the control during movement and in order to give the person sufficient support to keep his or her balance. During movement according to moments D and E, the front member 2 will swing as indicated by the arrows, which does not essentially affect the balance of the walking support. In moment F finally, it is shown that both lateral members 5 and 6 may be moved at the same time if they are displaced relative each other such that the support e.g. may be moved through a narrow aperture 30 of a door.

From the above operating description it is clear that the present walking support is foldable, which is advantageous since it takes little place during transport and storage. Furthermore, the walking support may be formed in various ways during movement for facilitating the movement especially in and through narrow spaces and for performing physiotherapeutic training while maintaining the required feeling of safety for the user.

Depending on the handicap of the user it may be advantageous to be able to limit the swinging movement of each lateral member 5 and 6 relative the front member 2. In the walking support shown this is accomplished by letting each lateral member 5 and 6 cooperate with at least one locking device 31, which, on the one hand, is adjustable for limiting the swinging movements of the lateral members 5 and 6 relative the front member 2 so that the lateral member is pivotable a limited number of degrees preferably from 0° to maximum 20–40°, outwards or inwards from a neutral position at which the lateral member 5 or 6 runs substantially at an angle normal to the front member 2 and, on the other hand, is releasable for folding the walking support. The locking device 31 has preferably rods 32 and 33 respectively, pivotally connected to the lateral members 5 and 6 respectively, engaging a clutch in a retainer 34 mounted on the front member and are locked at this retainer.

Figures 10A, 10B, 10C, 10D, 10E, 10F:
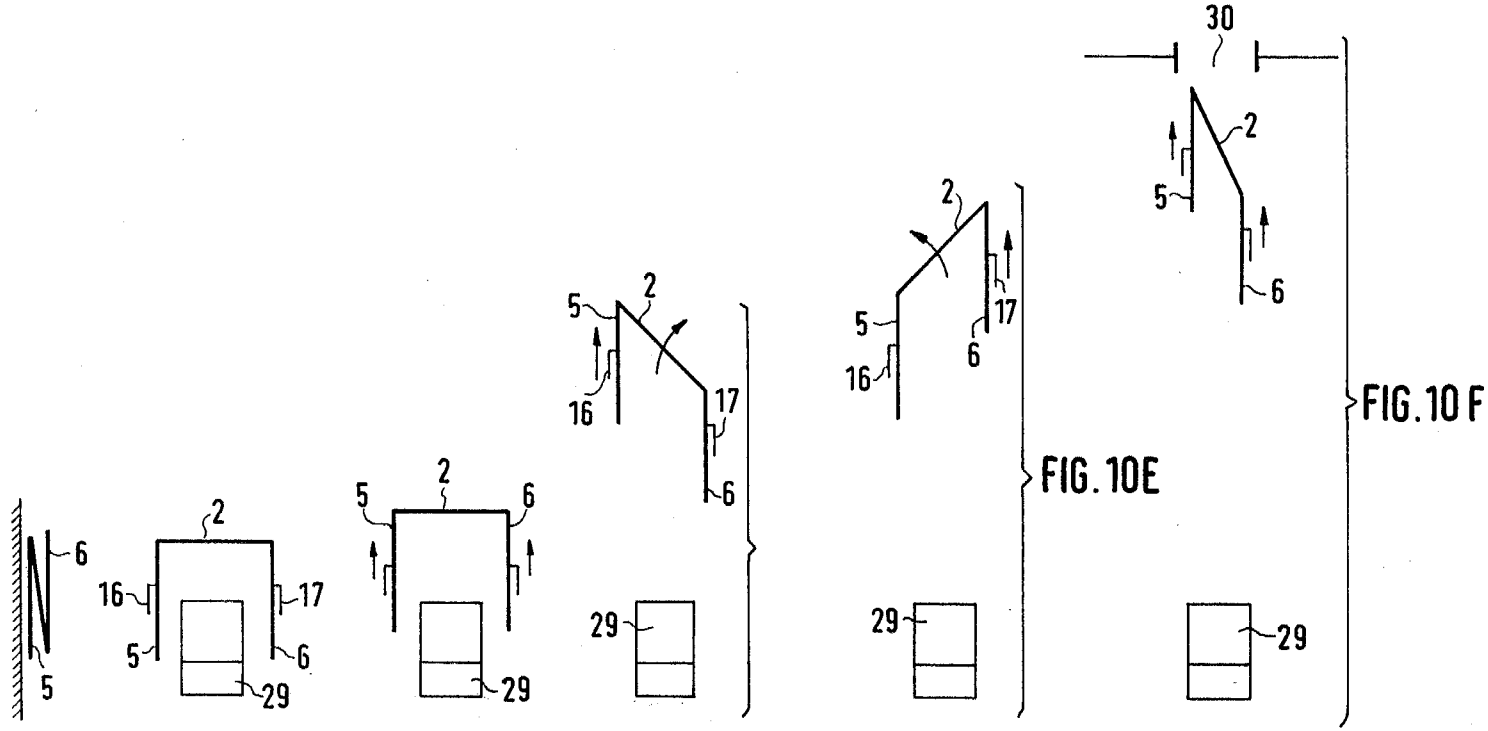

In order to be able to fold together the walking support after release of the locking device, as is shown in FIG. 10 A, every lateral member 5 and 6, may extend from the link via which it is connected to the front member 2 lying in another plane than the front member, and is arranged to swing to a position in which it runs substantially parallel to the front member and with the part thereof closest to the link 3 and 4 respectively, beneath the front member. In order to provide simple and stable constructions regarding the links 3, 4 and the supporting of the front wheels 35 and 36, each link comprises principally a bearing 37 with a joining function and connected to the wheel.

In some instances it may be advantageous to alter the position of each handle 16, 17 relative the direction of movement. This is accomplished in a simple manner by mounting each handle to pivot around a vertical portion of the handle member 9 and 10 respectively.

To provide for the handle members 9, 10 to be as long as possible and settable as low as possible without interfering in the lateral members 5, 6, each supporting means 7, 8 is mounted on a central member 38 of the lateral member, whereby the central member lies on a lower level than parts of the lateral member 5 or 6 on both sides thereof.

The various arrangements in the walking support have been only principally described, since their structural shape may vary. As a more detailed explanation of the embodiment shown, it may be noted that each stand 11, 12 comprises a tube welded to the lateral member 5 or 6 and that the handle member 9 and 10 respectively, comprises a tube 39 displaceable in the stand and at which the handle 16 and 17 respectively, is pivotally connected via a clamping element 40 that may be braced around the upper end of the tube 39 by means of a screw 41.

At the embodiment of the locking mechanism 13 shown in FIGS. 2 and 3, the wedge means 18 is mounted down below on the tube 39 and the releasing device 15 has a rod 42 which on top is provided with a control button 43 arranged so that it is accessible to be pressed down with the thumb when holding on to the handle 16 or 17. The rod 42 is kept in an upper position by means of the spring 22, positioned between a fixed stop 44 on the rod and a second stop 45 disposed below the fixed stop and mounted on the tube 39 via screws 46. A yoke 47 is mounted down below on the rod and it grips the wedge element 20 and permits it to wedge up between the wedge means 18 and the inner wall of the tube of the stand. By pressing down the button 43, the rod 42 and the yoke 47 are pushed downwards, whereby the wedge element 20 is forced downwards, i.e. out of its wedged up position such that the handle member 9 and 10 respectively, may be brought down into the tube of the stand.

FIG. 8 illustrates a locking mechanism 14 operating essentially as the locking mechanism 13 but differing in some details. At the locking mechanism 14 the wedge means 18 has four seats 48 for spherical wedge elements 21. Instead of a yoke the rod 42 has a sleeve 49 with apertures 50 for the wedge elements 21. The locking mechanism 14 is shown in FIG. 8 having its wedge elements 21 moved to a neutral position and the same has somewhat more details than the locking mechanism 13, but is less sensitive to break downs. The locking mechanisms included in the supporting means 7 and 8 may of course be designed in many other ways and still maintain the desired function.

The braking device 23 and 24 respectively, may also be designed in various ways. An especially stable and simple construction is provided by journalling the rear wheels 25 and 26 respectively, in a yoke 51 and mounting the return element in the form of a spring 28 between said yoke 51 and an inclined upwardly directed rear portion of the lateral member 5 and 6 respectively. The yoke 51 is pivotally connected to the lateral member via a link 52 and the braking portion comprises a brake block 27 mounted on the rear portion. Thus, the rear wheel 25, 26 is not pivotable around a vertical pivot axle to ensure such driving stability as is mostly necessary for safe driving of the walking support. By this journalling of the rear wheel it is also possible to provide a simple and safe brake.

The retainer 34 of the locking device 31 may be provided with a tightening screw 53 for adjusting the friction between the retainer 34 and the rods 32 and 33, so that the rods become difficult to move or completely fixed by tightening the screw 53. The rods 32, 33 and preferably connected to the lateral members 5 and 6 respectively, via linkages 56. The locking device for limiting the swinging movements of the lateral members may be designed in many ways, e.g. simple chains may be used which are mounted on each lateral and extend to the front member.

Each link 3 and 4 respectively, comprises in the embodiment shown, a sleeve 58 that is fixedly mounted on the lateral member 5 and 6 respectively, and journalled on the bearing 37. An outer sleeve 57 is pivoted on the sleeve 58 and connected to the front member 2. A link of this construction is simple, stable and easy to install, but of course other variations are possible. Retainers 54 and 55 for the front wheels 35 and 36 respectively, are preferably arranged to pivot around a vertical axle to permit best possible flexibility when driving the walking support.

The alternatives described and illustrated above, have for their object to show how arrangements included in the walking support may vary within rather wide limits. It is important that the various arrangements permit the user of the walking support, only via the supporting means 7 and 8, to control the support by e.g. simultaneously move forward both lateral members 5 and 6 or one lateral member at the time, to simultaneously raise or lower both handle members 9 and 10 or one handle member at a time and to simultaneously brake both rear wheels 25 and 26 or one rear wheel at a time.

What is claimed is:

1. A walking support device having a wheeled frame (1) and supporting means (7 and 8 respectively) for the user of the walking support mounted thereon, whereby the rear wheels (25 and 26 respectively) of the frame are mounted on lateral members (5 and 6 respectively) which are pivotally connected to at least one front member (2) of the frame through links (3 and 4 respectively), wherein the supporting means (7 and 8 respectively) are mounted on the lateral members (5 and 6 respectively) to permit the user of the walking support to move one lateral member at a time.

2. A device according to claim 1 wherein each supporting means (7 and 8) comprises a handle member (9 and 10 respectively) which is vertically adjustably connected to a stand (11 and 12 respectively) mounted on the lateral member (5 and 6 respectively) and which is provided with a locking mechanism (13 or 14) that permits raising of the handle member when this is pulled upwards but lowering of the handle member when this is pressed downwards only after releasing the locking mechanism.

3. A device according to claim 2 wherein the locking mechanism (13 or 14) is releasable by means of a releasing device (15) reaching up to a handle (16 and 17 respectively) mounted on the handle member (9 and 10 respectively), whereby the locking mechanism comprises at least one wedge means (18 or 19) mounted on the handle member (9 and 10 respectively) between which and the stand (11 and 12 respectively) is arranged at least one wedge member (20 or 21) which by being wedged up between the wedge means and the stand, prevents the handle member from moving downwards when loaded, and whereby the releasing device is adapted to move the wedge member from locking position by pressing down the same against the action of a return spring (22).

4. A device according to claim 2, wherein each handle member (9 and 10 respectively) comprises a handle (16 and 17 respectively) which is mounted to pivot around a vertical portion of the handle member.

5. A device according to claim 1 wherein each lateral member (5 and 6 respectively) comprises a braking device (23 and 24 respectively) for braking its wheels (25 and 26 respectively), whereby said locking device comprises at least one braking portion (27) which, when applying a load on the lateral member from above against the action of a return element (28), moves towards the wheel and engages the wheel for blocking its rotation.

6. A device according to claim 1 wherein each lateral member (5 and 6 respectively) cooperates with at least one locking device (31), which, on the one hand, is adjustable for limiting the swinging movements of the lateral members relative the front member (2) so that the lateral member is pivotable a limited number of degrees, preferably from 0° to maximum 20°–40°, outwards or inwards from a neutral position at which the lateral member runs substantially at an angle normal to the front member and, on the other hand, is releasable for folding the walking support.

7. A device according to claim 6 wherein the frame (1) comprises front wheels (35 and 36 respectively), the retainers (54 and 55 respectively) of which are mounted to pivot around a vertical axle and rear wheels (25 and 26 respectively), the retainers (51) of which are mounted to pivot around a horizontal axle (52).

8. A device according to claim 1 wherein each lateral member (5 and 6 respectively), extends from the link (3 and 4 respectively) via which it is connected to the front member (2) lying in another plane than the front member, and is arranged to swing to a position in which it runs substantially parallel to the front member and with the part thereof closest to the link beneath the front member.

9. A device according to claim 1 wherein each link (3 and 4 respectively) comprises a bearing (37) connected to the wheels (35, 36) of the frame (1), a sleeve (58) journalled on the bearing and connected to the lateral member (5 and 6 respectively) and a second sleeve (57) pivoted on said first sleeve and connected to the front member (2).

10. A device according to claim 1 wherein each supporting means (7 and 8 respectively) is mounted on a central member (38) of the lateral member (5 and 6 respectively) whereby the central member lies on a lower level than parts of the lateral member on both sides thereof.

* * * * *